United States Patent [19]

Halsey et al.

[11] Patent Number: 4,998,612

[45] Date of Patent: Mar. 12, 1991

[54] METER BOX WITH HIDDEN HINGED DOOR

[75] Inventors: Johnny H. Halsey; James H. Halsey, both of El Dorado, Ark.

[73] Assignee: IDX, Inc., El Dorado, Ark.

[21] Appl. No.: 336,146

[22] Filed: Apr. 11, 1989

[51] Int. Cl.[5] ..... G07F 17/20

[52] U.S. Cl. ..... 194/350; 49/398; 16/264

[58] Field of Search ..... 194/350, 241, 242; 221/281; 109/73, 74; 232/15, 16; 49/398; 16/229, 261-264

[56] References Cited

U.S. PATENT DOCUMENTS

| | | | |
|---|---|---|---|
| 4,437,558 | 3/1984 | Nicholson et al. | 194/320 X |
| 4,469,213 | 9/1984 | Nicholson et al. | 324/236 X |
| 4,544,081 | 10/1985 | Voegeli | 194/350 X |
| 4,821,862 | 4/1989 | Nelson | 194/350 X |
| 4,854,009 | 8/1989 | Brockhaus | 16/263 |

FOREIGN PATENT DOCUMENTS

| | | | |
|---|---|---|---|
| 1217158 | 12/1970 | United Kingdom | 16/264 |

*Primary Examiner*—F. J. Bartuska

*Attorney, Agent, or Firm*—Diller, Ramik & Wight

[57] ABSTRACT

A meter box including a cabinet housing components, such as a coin/token acceptor, which must be accessed for replacement or repair, the cabinet including a body having an interior chamber accessed by a door pivotally mounted about a generally horizontal axis for pivoting movement between a first vertically disposed closed position and a second generally horizontally disposed open position, the replaceable/repairable components being housed within the interior chamber and/or upon the door, and a surface portion of the door in the horizontal open position thereof defining a work surface to facilitate intricate manipulative repairs of components thereupon.

17 Claims, 2 Drawing Sheets

METER BOX WITH HIDDEN HINGED DOOR

BACKGROUND OF THE INVENTION

This invention is directed to meter boxes into which coins or tokens are inserted to selectively condition machines for operation. The meter box of the present invention is particularly adapted for use in association with automobile or car washing installations in which the users insert appropriate coins/tokens into a coin/-token acceptor housed within the meter box, rotate a selector switch to condition the system to selectively dispense presoak, wash, rinse, or like solutions, and allow the solutions to be dispensed through a conventional manually operated trigger wand.

Since such conventional meter boxes are known to contain money, they are subject to vandalism, abuse, destruction, and theft. Furthermore, the latter of simple wear and tear requires components thereof to be repaired or replaced easily, quickly and correctly.

SUMMARY OF THE INVENTION

The present invention is directed to a novel meter box which is extremely sturdy and, therefore, resists all but the most destructive forces. However, apart from the rigidity of the meter box, the same is provided with a recessed front door which closely fits the contour of the front periphery of the meter box, and this in turn prevents screwdrivers, pry bars or similar tools from being used to break the door and gain access to the meter box. Furthermore, except for an exterior rotary switch and the lock, all of the components associated with the meter box are housed in an interior chamber thereof, including pivots for the door. Accordingly, except for total destruction of the meter box, the door can not be removed by exterior manipulation of the pivot pins or the removal thereof, as is possible in conventional meter boxes.

The door is also so constructed and arranged as to be disposed in a generally horizontal position when opened thereby exposing replaceable or repairable components for ready access which may be carried by the door itself or housed within the interior chamber of the meter box. In both of the latter aspects of the invention the door in its horizontal position offers a relatively stable flat work surface upon which components can be placed for repair and replacement. Preferably those components which are most subject to repair or replacement, particularly the rotary selector switch and the coin/token selector mechanism, are mounted upon the door, and of these the coin/token acceptor mechanism is preferably mounted on the door in a manner which permits access thereto only from the interior of the meter box.

Accordingly, in keeping with the present invention, the meter box must be virtually totally destroyed before its contents can be accessed and the exterior of the meter box offers no visual clue as to what might be the easiest illegal access to the meter box interior. Thus, with the meter box door closed the meter box represents and essentially vandal proof cabinet, yet when the door is disposed in its horizontal position, the components thereof are readily accessed, repaired and/or replaced.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figures 1, 2:
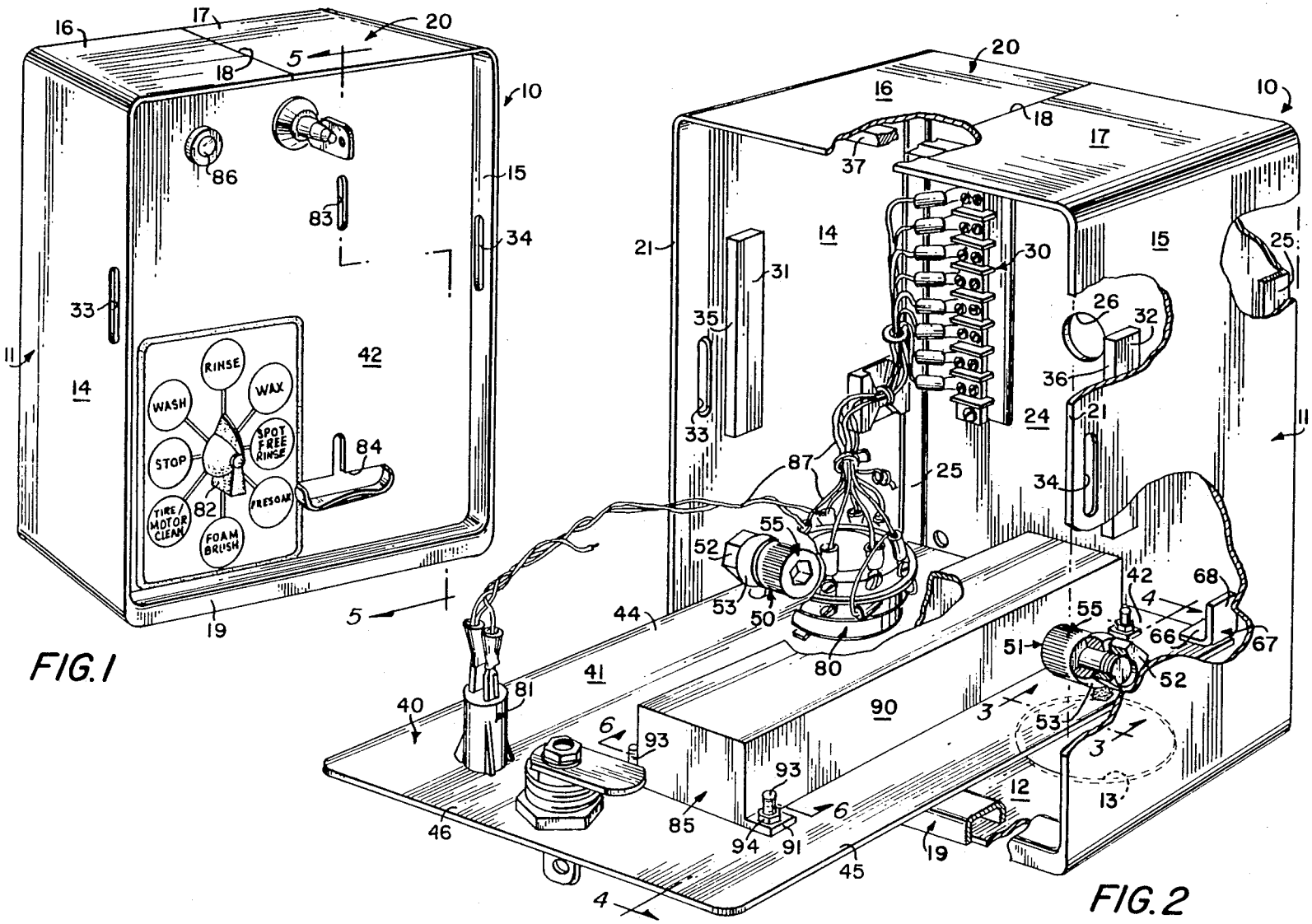
FIG. 1 is a front perspective view of a novel meter box or cabinet constructed in accordance with this invention, and illustrates a recessed front door carrying a rotary selector switch, a lock and a coin/token inlet and return slot.
FIG. 2 is an enlarged fragmentary perspective view of the meter box or the cabinet of FIG. 1 with parts broken away for clarity, and illustrates the door pivoted to its horizontal position, the pivots thereof, and the components carried by the door subject to replacement and/or repair.

A novel meter box or meter cabinet constructed in accordance with this invention and generally designated by the reference number 10 (FIGS. 1, 2, 4 and 5), and includes a generally tubular body 11 bent to a generally rectangular configuration and being defined by a bottom wall 12 (FIGS. 2, 4 and 5) having a central circular hole or an aperture 13 therein, opposite generally parallel side walls 14, 15, and the latter being bent into top wall portions 16, 17, respectively, welded at 18. The wall portions 16, 17 collectively define a top wall 20 which is generally parallel to the bottom wall 12. The generally polygonal or rectangular body 11 further is set-off by a front edge or edge portion 21 and a rear edge or edge portion 22. The front and rear edges 21, 22, respectively, lie in planes which are parallel to each other.

The tubular body 11 is closed along the rear edge 22 by a rear wall 24 which has an internally directed peripheral flange 25. The peripheral flange 25 bounds the entire periphery of the rear wall 24 and snuggly mates against the interior surfaces (unnumbered) of the walls 12, 14, 15 and 20, and is welded thereto along the rear edge 22 thereby rigidifying the rear side of the meter box 10. One or more openings 26 are formed in the rear wall 24. The opening 26 is utilized to connect an internal electrical contact board 30 conventionally fastened to the rear wall 24 to exterior circuitry forming no part of the present invention which permits the meter box 10 to be utilized with an appropriate mechanism, such as the car wash heretofore noted. The larger opening 13 in the bottom wall 12 can be used, for example, to secure the meter box 10 to a vertical support, such as a rigid stainless steel pipe to which the bottom wall 12 can be welded.

The bottom wall 12 is rigidified along the front edge 21 by means of a generally inverted U-shaped reinforcing member 19 having a generally horizontal bight wall 27, an outermost leg 28 and an innermost leg 29. The legs 28, 29 are welded to the front edge portion 21 of the bottom wall 12.

Two additional reinforcing and abutment members 31, 32 are welded to the respective side walls 14, 15 adjacent respective elongated slots 33, 34. The reinforcing and abutment members 31, 32 have respective front abutment surfaces 35, 36 which lie in a common plane which is also common to a front abutment surface 37 (FIGS. 2 and 5) of a reinforcing and abutment member 38 welded to the interior surface (unnumbered) of the top wall portions 16, 17.

A front door 40 of a generally rectangular or polygonal configuration is defined by an interior surface 41 which is relatively flat and planar, an exterior surface 42, a bottom edge or edge portion 42, opposite generally parallel side edges or side edge portions 44, 45 and a top edge or top edge portion 46. The overall profile of the door 40, as set off by the edges 42, 44, 45 and 46 corresponds to the overall profile of the front edge 21 as established by the corresponding walls 12, 14, 15 and 20. Thus, the door 40 in its closed position (FIGS. 1 and 5) is in snug, intimate contiguous relationship to the peripheral front edge portion 21 of the annular body 11, and is recessed approximately 1 inch therein. This snug fit and the recessed relationship virtually precludes a vandal or any other unauthorized individual from gaining access to an interior I of the meter box 10 by attempting to insert a screwdriver, pry bar or like tool between the door 40 and the annular body 11.

Figure 3:
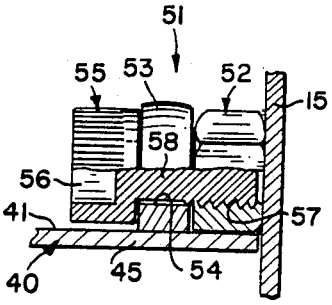
FIG. 3 is an enlarged view taken along line 3—3 of FIG. 2, partially in axial cross-section and partially in side elevation, and illustrates one of the two identical pivots for pivotally securing the door to a side wall of the meter box.
Figure 6:
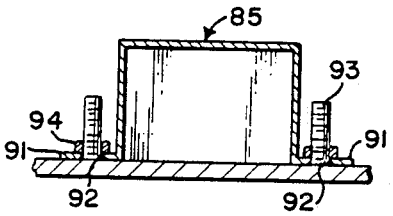
FIG. 6 is a cross-sectional view taken generally along line 6—6 of FIG. 2, and illustrates a coin/token comparator or acceptor secured to an internal surface of the door.

Identical means 50, 51 (FIG. 2) are provided for pivotally securing the door 40 to the side walls 14, 15, respectively, of the meter box 10 to facilitate pivoting movement of the door 40 between the closed position (FIGS. 1 and 5) thereof and the opened position (FIGS. 2 and 4) thereof. The pivot means 50, 51 each include an identical nut 52 welded to an inner surface (unnumbered) of the side walls 14, 15 (FIG. 3). An annular ring or pintle 53 having a circular opening 54 is also welded to the inner surface 41 of the door 40 at each of the side edges 44, 45. A cap screw 55 having a recessed head 56 is secured by a threaded end portion 57 to each of the nuts 52 while a cylindrical portion 58 of each cap screw 55 generally mates with and serves as a pivot for the associated pintle 53. The pivot means 50, 51 have a common or coaxial axis and, thus, the door 40 is pivoted relatively accurately between the two positions aforesaid. It should be particularly noted from FIGS. 1 and 3 that since the nuts 52 are welded to the interiors of the side walls 14, 15, the pivot means 50, 51 are not accessible from the exterior of the meter box 10, nor do the side walls 14, 15 even provide any indication that the door 40 is a door or is a pivoted door. Thus, anyone desiring to gain access to the interior I of the meter box 10 might quickly decide any effort at removing the front door panel 40 would prove difficult if not impossible, since no visible connection between the door 40 and the body 11 is evident from exterior inspection of the overall meter box 10. Furthermore, the door 40 is so locked in its closed position (FIGS. 1 and 5) as to further dissuade a vandal from attempting to open the same.

Figure 5:
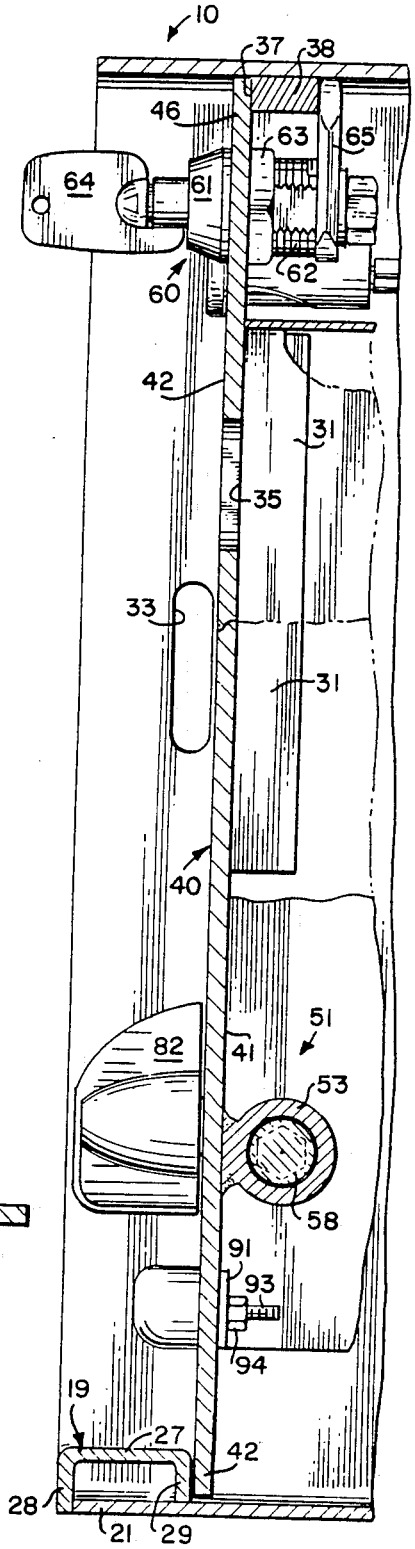
FIG. 5 is an enlarged fragmentary cross-sectional view taken generally along line 5—5 of FIG. 1, and illustrates the door in its vertical locked position.

Referring specifically to FIG. 5, when the door 40 is in its vertical/closed position, its inside surface 41 abuts the surfaces 35, 36 and 37, as heretofore noted, and its exterior surface 42 adjacent its bottom edge 42 abuts the outer surface (unnumbered) of the innermost leg 29 of the reinforcing member 26 (FIG. 5). Thus, the bottom, top and both side edges of the door 40 are rigidly abuttingly reinforced and are maintained in this relationship by conventional locking means 60 which is connected in an opening (not shown) of the front door 40. The locking means 60 includes an exterior annular shoulder 61 and a threaded stem 62 upon which is threaded a threaded nut 63 located within the interior chamber I. When the nut 63 is tightened, the shoulder 61 and the nut 63 intimately engage the door 40 and, obviously, the nut 63 can not be accessed unless the door 40 is opened or removed. A conventional key 64 can be inserted into the locking means or lock 60 to pivot a locking lug 65 between the locked position (FIG. 5) behind the reinforcing and abutment member 38 and an unlocked position (FIG. 2) at which the door 41 can be opened.

Figure 4:
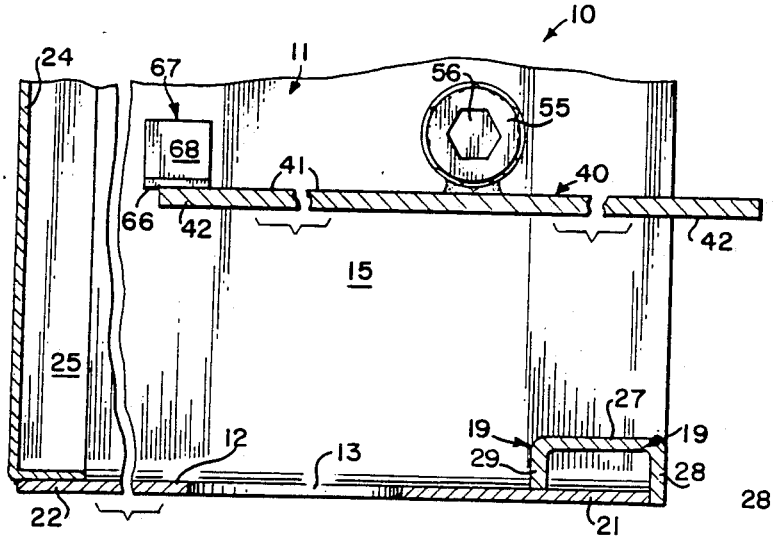
FIG. 4 is a fragmentary enlarged cross-sectional view taken generally along line 4—4 of FIG. 2, and illustrates the door in its horizontal position with a lower edge thereof contacting a stabilizer abutment carried by a side wall of the meter box.

When the door 40 is opened, the inner surface 41 adjacent the bottom edge 42 contacts a leg 66 of an angle bar abutment member 67 having another leg 68 welded to an interior surface of the wall 15 (FIGS. 2 and 4). A similar abutment member can be welded to the inner surface (unnumbered) of the side wall 14 with the leg (not shown) thereof corresponding to the leg 66 being aligned with the leg 66 of the illustrated angle-bar abutment member 67. Thus, when the door 40 is in its opened position, the upper surface 41 is maintained virtually horizontally disposed or in a horizontal plane which facilitates a person gaining access to various repairable/replaceable components housed within the interior I, such as the electrical contactor strip 30 carried by the rear wall 24 or other components, such as a conventional rotary switch 80, a conventional indicator light socket 81 and/or a conventional coin/token acceptor and comparator 85. The rotary switch 80 is suitably connected upon the interior surface 41 of the door 40 and has a manually operative stem (unnumbered) projecting through an opening (not shown) which in turn carries a knob or handle 82 which can be manually rotated to and through various positions appropriately marked on the front surface 42 of the door 40, such as "WASH", "RINSE", etc. When a coin or token is inserted through a slot 83 (FIG. 1) of the door 40 and is not discharged through a token/coin return slot 84, but is instead found "acceptable" by the coin/token acceptor mechanism 85, a light/bulb 86 in the socket 81 will light evidencing to a user that the knob 82 can then be selectively rotated, and the position of the knob 82 through electrical wiring 87 (FIG. 2) conditions the exterior mechanism associated with the meter box 10 for utilization as, for example, a conventional car washing mechanism having a trigger wand which can be directed toward an automobile during "WASH", "RINSE", etc. selections of the selector knob or switch 82. Whether a coin or token is accepted or rejected depends upon the conventional mechanics and circuitry of the coin/token acceptor/comparator, and though the details thereof are not specifically described herein, conventional mechanisms might be utilized as disclosed in Nicholson et al U.S. Pat. Nos. 4,437,558 and 4,469,213 issued respectively Mar. 20, 1984 and Sept. 4, 1984 and entitled COIN DETECTOR APPARATUS and COIN DETECTOR SYSTEM, respectively. A typical coin comparator constructed in accordance with these patents is "Coin Comparitor Model CC-40" of Coin Mechanisms Inc. of 817 Industrial Drive, Elmhurst, Ill. 60126. The mechanical and electrical disclosures of the latter are incorporated hereat totally by reference in order not to unduly lengthen this disclosure.

Preferably a housing 90 of the comparator/acceptor 85 is provided with a number of identical flanges 91 each having an opening 92. A threaded stem 93 welded to the door 94 passes through each of the openings 92 of each of the flanges 91 and is secured thereto by a threaded speed nut 94. It should be particularly noted that due to the welding of the threaded stems 93 to the interior surface 41 of the door 40, there is no visual indication from the exterior of the door 40 when closed as to the precise location of the acceptor/comparator 85 relative to the door 40 or the manner in which the same is attached thereto. Thus, one attempting to gain access to the interior I might be inclined to make some judgments depending upon the location of the coin/token acceptor/comparator 85 thereof, but without knowledge of the manner in which the latter is secured within the interior I of the meter box 10, a vandal might find it difficult to make a sound judgment as to effecting entry to the meter box interior I.

Because of the location of the surface 41 in a generally horizontal plane when the door 40 is opened, those components which most likely can be damaged or jammed in use, such as the rotary switch 80, the lamp 86 of the lamp socket 81 and the coin/token acceptor/-comparator can be readily removed from the door 40 and, for example, placed upon the horizontally disposed surface 41 incident to repair/replacement. Thus, the door 40 in its opened position is not only disposed in a generally horizontal plane, but it is rigidly supported in this plane by the abutment means 67, and this allows a technician/repairman to make whatever repairs/replacements might be necessary utilizing the surface 41 as a "work surface" to facilitate such replacement-/repair. For example, the speed nuts 92 can be rapidly removed from the threaded stems 93, the mechanism 85 lifted from the restraint of the threaded stems 93 and repositioned upon the surface 41 for appropriate work-/repair, and when the latter is completed, the mechanism 85 need be but returned to its original position, the speed nuts 94 reapplied, and the door 40 closed and locked.

As a precautionary measure, once the door is locked by the locking means 60, a conventional hardened steel security bar can be slipped through the slots 33, 34 and conventionally locked in place to further prevent unauthorized access to the interior I of the meter box 10.

Although a preferred embodiment of the invention has been specifically illustrated and described herein, it is to be understood that minor variations may be made in the apparatus without departing from the spirit and scope of the invention, as defined in the appended claims.

We claim:

1. A cabinet housing components which must be accessed for replacement or repair comprising a cabinet body defining an interior chamber adapted to house replaceable or repairable components, a door accessing said interior chamber, means for pivotally mounting said door for pivoting movement about a horizontal axis between a first generally vertically disposed position and a second generally horizontally disposed position, means for releasably locking said door in said first position, means for supporting said door in said second position whereby said door functions as a stable horizontal work surface during the replacement or repair of components adapted to be housed within said interior chamber, said cabinet body includes a pair of opposite spaced side walls, said pivotal mounting means being in part carried by each of said side walls and in part by said door, and said pivotal mounting means part carried by each of said side walls is welded to an interior surface of an associated side wall thereby being concealed from exterior view by said side walls.

2. The cabinet as defined in claim 1 including a replaceable or repairable component housed within said interior chamber.

3. The cabinet as defined in claim 1 including a replaceable or repairable component housed within said interior chamber and upon said door.

4. The cabinet as defined in claim 1 including a replaceable or repairable component housed within said interior chamber and upon said door, and means for rapidly releasable securing said replaceable or repairable component upon said door.

5. The cabinet as defined in claim 1 wherein said door has upper and lower end portions, and said pivotal mounting means is located at said lower end portion whereby a major portion of said work surface projects outwardly of said interior chamber in said second position.

6. The cabinet as defined in claim 1 including means carried by said cabinet body against which an upper door inner surface portion abuts in said first door position.

7. The cabinet as defined in claim 1 wherein said door supporting means defines a generally horizontal abutment surface against which said door abuts in said second door position.

8. The cabinet as defined in claim 1 wherein said door supporting means defines a generally horizontal abutment surface carried by a side wall portion of said cabinet against which said door abuts in said second door position.

9. The cabinet as defined in claim 1 including a replaceable or repairable component housed within said interior chamber and upon said door, said component includes a coin chute, and an opening in said door for feeding coins into said coin chute.

10. The cabinet as defined in claim 3 wherein said door has upper and lower end portions, and said pivotal mounting means is located at said lower end portion whereby a major portion of said work surface projects outwardly of said interior chamber in said second position.

11. The meter box as defined in claim 9 including electric timer and switch selector means housed within said interior chamber upon said cabinet body for selecting a particular coin controlled operation and the duration thereof.

12. The cabinet as defined in claim 1 wherein said pivotal means part carried by each of said side walls includes a pivot pin connected at a first end through a weld to an associated one of each of said side walls, each pivot pin having a second end opposite its first end, said pivot pins being in generally axially aligned relationship, said pivotal means part carried by said door being a pair of pintles, each pintle receives a pivot pin, and each pintle is secured to said door.

13. The cabinet as defined in claim 12 wherein said pivotal mounting means part carried by each side wall further includes a threaded nut welded to the inner surface of each of said side walls, and each pivot pin first end includes a threaded portion threaded into an associated one of said threaded nuts.

14. The cabinet as defined in claim 12 including means at each second terminal end for preventing sliding removal of each pintle from its associated pivot pin.

15. The cabinet as defined in claim 12 wherein said pivot pins and pintles are accessible only from the interior chamber.

16. A meter box comprising a cabinet body, said cabinet body including an interior chamber, a door for accessing said interior chamber, means for pivotally mounting said door for pivoting movement about a horizontal axis between a first generally vertically disposed position and a second generally horizontally disposed position, said cabinet body includes a pair of opposite spaced side walls, said pivotal mounting means being in part carried by each of said side walls and in part by said door, and said pivotal mounting means part carried by each of said side walls is welded to an interior surface of an associated side wall thereby being concealed from exterior view by said side walls, means for releasably locking said door in said first position, means for supporting said door in said second position whereby said door functions as a stable horizontal work surface during replacement or repair of a component adapted to be housed within said interior chamber, a component including a coin chute mounted upon said door, means for removably securing said component contiguous an inner surface of said door, a slot in said door through which coins are adapted to be fed to said coin chute, said door having upper and lower end portions, said pivotal mounting means being located at said lower end portion whereby a major portion of said work surface projects outwardly of said interior chamber in said second position, said pivotal mounting means being accessible only from the interior chamber, and an inner surface portion of said door being relatively flat to facilitate intricate manipulatable repairs of components in said second door position.

17. A cabinet housing components which must be accessed for replacement or repair comprising a cabinet body defining an interior chamber adapted to house replaceable or repairable components, a door accessing said interior chamber, means for pivotally mounting said door for pivoting movement about a horizontal axis between a first generally vertically disposed position and a second generally horizontally disposed position, means for releasably locking said door in said first position, means for supporting said door in said second position whereby said door functions as a stable horizontal work surface during the replacement or repair of components adapted to be housed within said interior chamber, said cabinet body includes a pair of opposite spaced side walls, said pivotal mounting means being in part carried by each of said side walls and in part by said door, said pivotal mounting means part carried by said side walls is concealed from exterior view by said side walls, said pivotal mounting means includes a pivot pin connected at a first end to an associated one of each of said side walls and having a second terminal end, said pivot pins being in generally axially aligned relationship, a pintle receiving each pivot pin, each pintle being secured to said door, and means at each second terminal end for preventing sliding removal of each pintle from its associated pivot pin.

* * * * *